US011793287B2

(12) United States Patent
Benezri

(10) Patent No.: US 11,793,287 B2
(45) Date of Patent: Oct. 24, 2023

(54) STROLLER CADDY

(71) Applicant: Lulyboo, LLC, Lake Forest, CA (US)

(72) Inventor: Pazit Benezri, Irvine, CA (US)

( * ) Notice: Subject to any disclaimer, the term of this patent is extended or adjusted under 35 U.S.C. 154(b) by 320 days.

(21) Appl. No.: 17/016,337

(22) Filed: Sep. 9, 2020

(65) Prior Publication Data

US 2021/0076794 A1 Mar. 18, 2021

Related U.S. Application Data

(60) Provisional application No. 62/900,542, filed on Sep. 15, 2019.

(51) Int. Cl.

| | |
|---|---|
| ***A45C 13/30*** | (2006.01) |
| ***A45C 3/00*** | (2006.01) |
| ***A45F 3/04*** | (2006.01) |
| ***A45C 13/02*** | (2006.01) |

(52) U.S. Cl.

CPC ..... *A45C 13/30* (2013.01); *A45C 3/00* (2013.01); *A45C 13/02* (2013.01); *A45F 3/04* (2013.01); *A45C 2013/026* (2013.01); *A45F 2200/0583* (2013.01)

(58) Field of Classification Search

CPC ..... A45C 13/30; A45C 3/00; A45C 13/02; A45C 3/04; A45C 2013/026; A45F 2200/0583

USPC ..... 224/585

See application file for complete search history.

(56) References Cited

U.S. PATENT DOCUMENTS

| | | | | |
|---|---|---|---|---|
| 4,186,859 | A * | 2/1980 | Frankfort | A45C 3/04 224/563 |
| 4,830,238 | A * | 5/1989 | Widinski | B62B 9/26 224/563 |
| 4,961,522 | A | 10/1990 | Weber | |
| 5,004,134 | A | 4/1991 | Barry | |
| 5,040,711 | A * | 8/1991 | Niederhauser | A01D 75/008 224/563 |
| 5,062,557 | A | 11/1991 | Mahvi et al. | |
| 5,649,658 | A | 7/1997 | Hoffman et al. | |
| 5,702,038 | A * | 12/1997 | Miller | B62B 9/26 150/108 |
| 5,941,437 | A * | 8/1999 | Okumura | A45F 3/02 224/586 |
| 5,961,018 | A | 10/1999 | Abelbeck et al. | |

(Continued)

FOREIGN PATENT DOCUMENTS

KR 20100029641 A1 3/2010

*Primary Examiner* — Peter N Helvey

(74) *Attorney, Agent, or Firm* — Rimas T. Lukas

(57) ABSTRACT

A stroller caddy is provided. The stroller caddy includes a smaller removable secondary caddy that is nested within a larger primary caddy. Each of the primary and secondary caddy includes straps for independently connecting each caddy to the handlebars of an infant stroller. When nested, the secondary caddy is connected to the primary caddy near the top opening of the primary caddy. A top panel of the secondary caddy provides beverage and cell phone receptacles. A top flap is provided to cover the top opening. The primary caddy serves as a diaper bag that can be carried like a backpack. The front panel of the primary caddy unzips on both sides to provide access from the front to a cabinet-like main compartment having one or more adjustable shelves. The front panel unfolds again to provide a sanitary and private baby-changing surface.

19 Claims, 7 Drawing Sheets

(56) References Cited

U.S. PATENT DOCUMENTS 6,199,737 B1 * 3/2001 Ringelstetter ..... E01H 1/1206 150/108
6,298,993 B1 10/2001 Kalozdi
D454,095 S 3/2002 Ornelas
6,390,260 B1 * 5/2002 Roegner ..... A47D 15/003 5/655
D470,803 S 2/2003 Hansen
7,779,976 B2 * 8/2010 Mangano ..... A45C 13/02 190/110
8,001,803 B2 8/2011 Kanagaki
D749,993 S 2/2016 Lee
9,771,183 B1 * 9/2017 Oliver ..... A45C 3/00
D833,736 S 11/2018 Voll et al.
10,413,030 B1 * 9/2019 Douglas ..... A45C 13/103
10,492,366 B1 * 12/2019 Knudsen ..... A01D 75/008
10,494,008 B1 * 12/2019 Scriba ..... B62B 3/1472
11,034,373 B2 * 6/2021 Fellema ..... B62B 3/1448
2002/0170935 A1 11/2002 Annis
2003/0024960 A1 * 2/2003 Greenstein ..... A45C 13/02 224/608
2004/0056057 A1 * 3/2004 Dixon ..... B62B 9/26 224/409
2006/0131840 A1 6/2006 Donay
2007/0209742 A1 * 9/2007 Morgan ..... A45C 3/08 150/113
2009/0127299 A1 5/2009 Jamlang
2009/0151826 A1 * 6/2009 Baxter ..... A45C 1/024 150/118
2009/0321487 A1 * 12/2009 Bergman ..... A45C 13/26 224/409
2010/0116859 A1 * 5/2010 Dessou-Tzafrir ..... A45C 13/02 383/22
2015/0041031 A1 * 2/2015 Sullivan ..... A45C 3/06 150/111
2016/0015155 A1 1/2016 Patel
2018/0025675 A1 * 1/2018 Sparks ..... G09F 3/201 224/585
2018/0206650 A1 * 7/2018 Kong ..... A45F 3/02
2019/0082817 A1 * 3/2019 Ji ..... A45F 3/04
2021/0106110 A1 * 4/2021 Schmidt ..... A45C 13/02

* cited by examiner

STROLLER CADDY

CROSS-REFERENCE TO RELATED APPLICATIONS

This application claims priority to and benefit of U.S. Provisional Patent Application Ser. No. 62/900,542 entitled "Stroller caddy" filed on Sep. 15, 2019 which is incorporated herein by reference in its entirety.

FIELD OF THE INVENTION

This application relates generally to backpacks, and in particular, to a backpack convertible to stroller caddy for carrying infant accessories and having a sanitary changing surface.

BACKGROUND OF THE INVENTION

Changing a baby on the go can be a challenging task, especially while away from home. Generally, parents or caregivers may try to find a baby changing station. Baby changing stations typically offer a convenient surface on which a baby can be placed for changing a diaper. Otherwise, changing a diaper in a car or on the ground can be difficult, inconvenient, and/or unhygienic. Furthermore, many accessories are required for the care of the baby and are ported together including items such as diapers, toys, pacifiers, beverages, hats, lotions, and wet napkins. In addition, adults also port items for their own use during outings with an infant including cell phones and adult beverages. Other items such as clothing for the child are also carried together. Many children outings are with an infant stroller where adult hands have to be free to maneuver the stroller. Manipulation of other items such as cell phones and carrying a beverage simultaneously take attention away from the many of the ported items which may be lost or dropped. Most importantly attention is diverted from the infant when many items for use by the baby and adult are not ported or stowed conveniently and securely.

SUMMARY OF THE INVENTION

According to one aspect of the invention, an infant care bag is provided. The infant care bag includes an outer bag having a top end and a bottom end. A front panel and a back panel are interconnected by a bottom panel, a first side panel and a second side panel that together define an interior having a top opening. The front panel is oppositely disposed from and parallel to the back panel. The first side panel is oppositely disposed from and parallel to the second side panel. A top flap is connected to the back panel and sized and configured to fold over the top opening. The outer bag includes a first outer bag strap having a proximal end and a distal end. The proximal end of the first outer bag strap is connected to the top end of the outer bag. The outer bag includes a second outer bag strap having a proximal end and a distal end. The proximal end of the second outer bag strap is connected to the top end of the outer caddy. The infant care bag includes a removable inner caddy having a top end and a bottom end. The inner caddy includes a front panel and a back panel interconnected by a top panel, a bottom panel, a first side panel and a second side panel. The front panel of the inner caddy is oppositely disposed from and parallel to the back panel of the inner caddy. The first side panel of the inner caddy is oppositely disposed from and parallel to the second side panel of the inner caddy. The inner caddy is sized and configured to removably nest inside the outer bag such that the top panel of the inner caddy is located at the top end of the outer bag and such that the top panel closes the top opening of the outer bag. When the inner caddy is nested inside the outer bag, the back panel, front panel, first side panel, and second side panel of the inner caddy face and are parallel to the back panel, front panel, first side panel and second side panel of the outer bag, respectively. The inner caddy includes a first inner caddy strap having a proximal end and a distal end. The proximal end of the first inner caddy strap is connected to the top end of the inner caddy. The inner caddy includes a second inner caddy strap having a proximal end and a distal end. The proximal end of the second inner caddy strap is connected to the top end of the inner caddy.

According to another aspect of the invention, an infant care bag is provided. The infant care bag includes a front panel having an inner surface and a back panel having an inner surface interconnected by a bottom panel having an inner surface, a first side panel having an inner surface and a second side panel having an inner surface that together define an interior having a top opening. The bag has a height from a top end to a bottom end. The front panel is oppositely disposed from and parallel to the back panel. The first side panel is oppositely disposed from and parallel to the second side panel. The bag includes a top flap connected to the back panel that is sized and configured to fold over and cover the top opening. The front panel has a first zipper along a first side edge of the front panel from the top end to the bottom end that is removably connectable to a zipper located along a front edge of the first side panel from the top end to the bottom end. The front panel has a second zipper along a second side edge of the front panel from the top end to the bottom end that is removably connectable to a zipper located along a front edge of the second side panel from the top end to the bottom end. When in an unzipped configuration, the front panel is configured to fold outwardly at an intersection with the bottom panel such that the inner surface of the front panel is coplanar with the inner surface of the bottom panel. The entire interior is accessible from the front when in the unzipped configuration. The bag has at least one removable shelf having a top surface and a bottom surface interconnected by a first side edge, a second side edge, a front edge, and a back edge.

According to another aspect of the invention, an infant care bag is provided. The infant care bag includes a caddy including a top end and a bottom end. The caddy includes a front panel and a back panel interconnected by a top panel, a bottom panel, a first side panel and a second side panel. The front panel of the caddy is oppositely disposed from and parallel to the back panel of the caddy. The first side panel of the caddy is oppositely disposed from and parallel to the second side panel of the caddy. The caddy includes a first caddy strap having a proximal end and a distal end. The proximal end of the first caddy strap is connected to the first side panel at the top end of the caddy. The caddy includes a second caddy strap having a proximal end and a distal end. The proximal end of the second caddy strap is connected to the second side panel at the top end of the caddy. The first caddy strap and the second caddy strap are sized and configured to removably attach to and hang from an infant stroller. The caddy includes a wedge-shaped opening formed in the top panel.

DETAILED DESCRIPTION OF THE INVENTION

Figure 1:
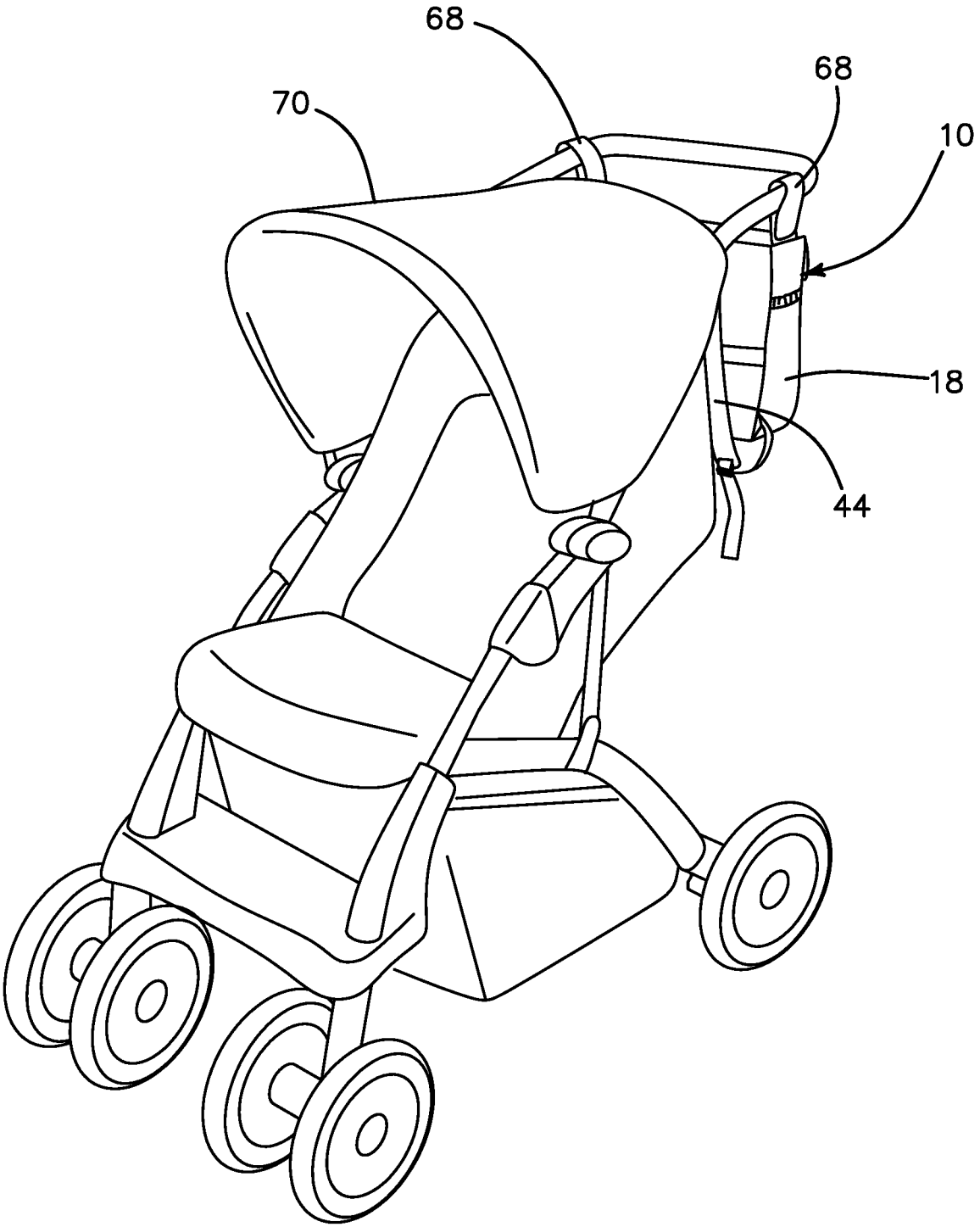
FIG. 1 is a top perspective view of a stroller caddy according to the present invention attached to a stroller caddy.

Turning now to FIGS. 1-7, the present invention will now be described in detail. A backpack 10 includes a front panel 12 and a back panel 14 interconnected by a first side panel 16, a second side panel 18 and a bottom panel 19 to define a main interior compartment 20. A top flap 22 is connected to the top edge of the back panel 14 and configured to fold over and close a top opening 24 that is open and provides access to the main interior compartment 20. All the panels are made of fabric material that is suitable and sturdy such that the backpack 10 maintains a rectangular box-like shape. The panels and top flap include an outer fabric covering and an inner fabric covering with cushion material sandwiched therebetween. All the panels maintain sufficient rigidity to not to collapse or flop over.

The front panel 12 includes an inner surface 30 and an outer surface 32. The front panel 12 is attached to the front edge of bottom panel 19. Side edges of the front panel 12 are connected to the front edges of the first side panel 16 and second side panel 18 with two separate zippers 26, 28. In particular, one side edge, the first side edge of the front panel 12 is provided with a first zipper 26 that is connectable to the other half of the first zipper 26 located on the edge of the first side panel 16. The other side edge, the second side edge, of the front panel 12 is provided with a second zipper 28 that is connectable to the other half of the second zipper 28 located on the edge of the second side panel 18. The first zipper 26 and the second zipper 28 extend between the bottom panel 19 and the top of the first side panel 16 and second side panel 18, respectively. The first zipper 26 and second zipper 28 extend along the front edges of the first side panel 16 and the second side panel 18, respectively.

Figure 3:
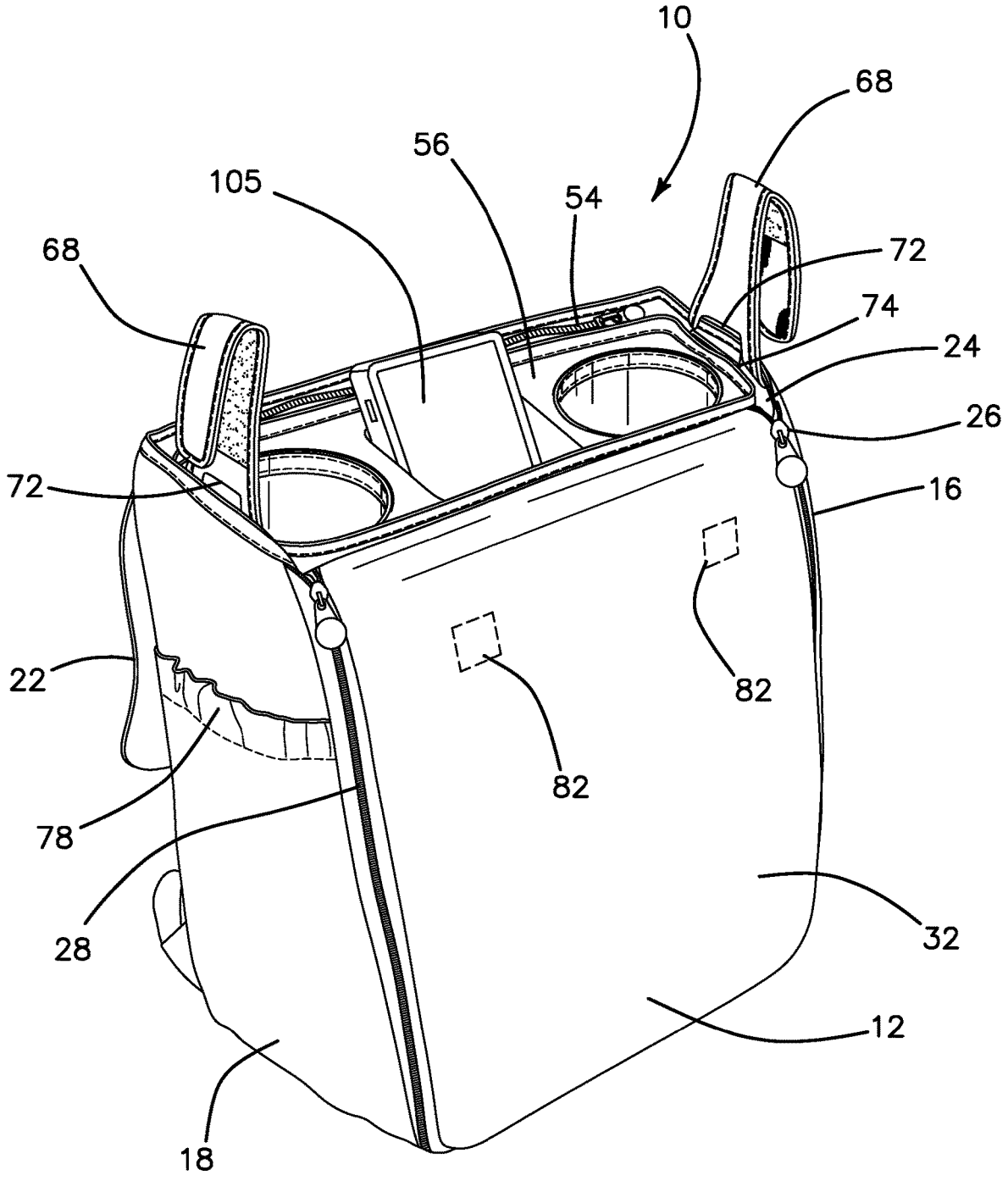
FIG. 3 is a top perspective view of a cell phone inside a stroller caddy with the top flap open according to the present invention.
Figure 4:
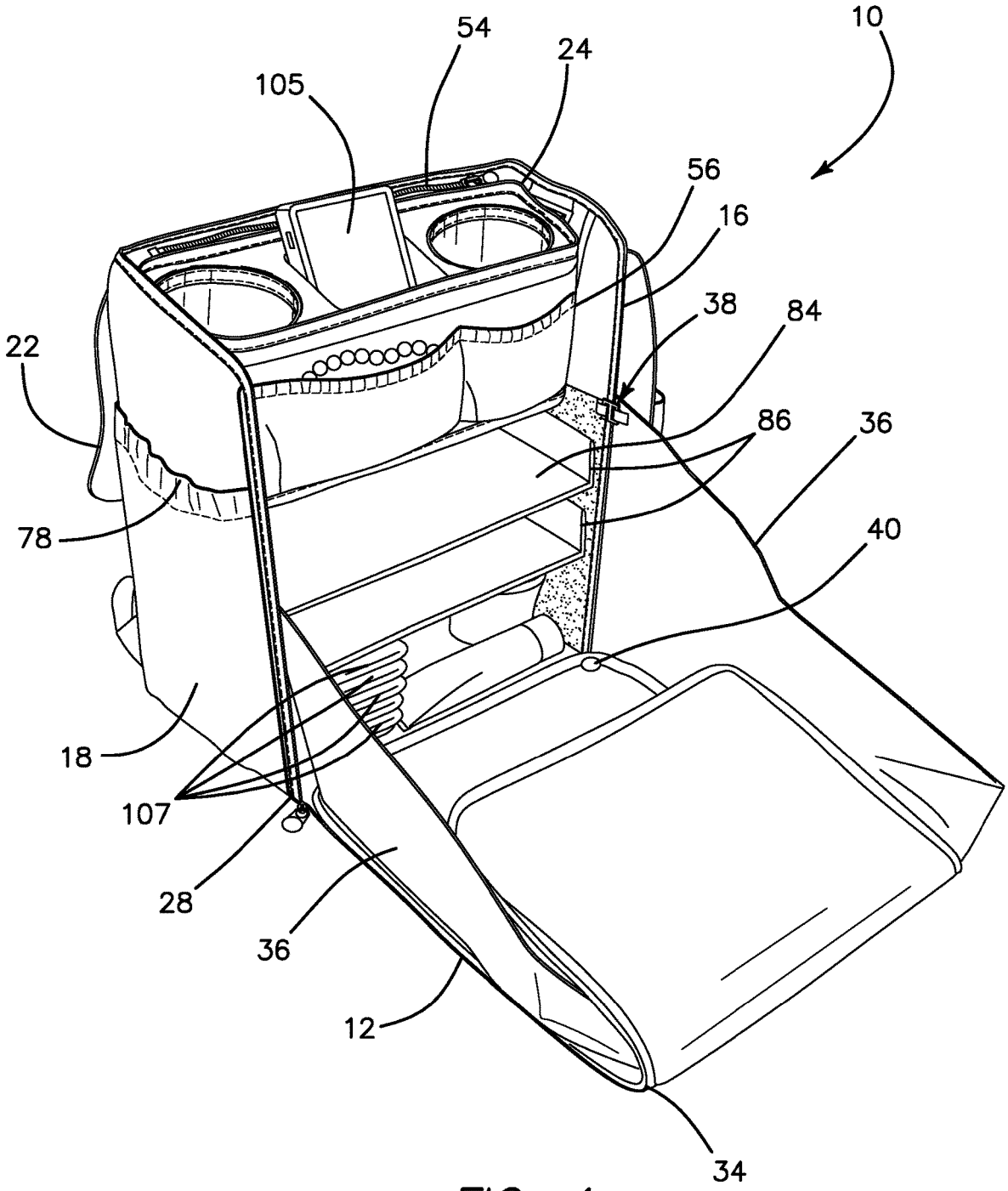
FIG. 4 is a top perspective view of a cell phone and baby accessories inside a stroller caddy with the front panel unzipped according to the present invention.
Figure 5:
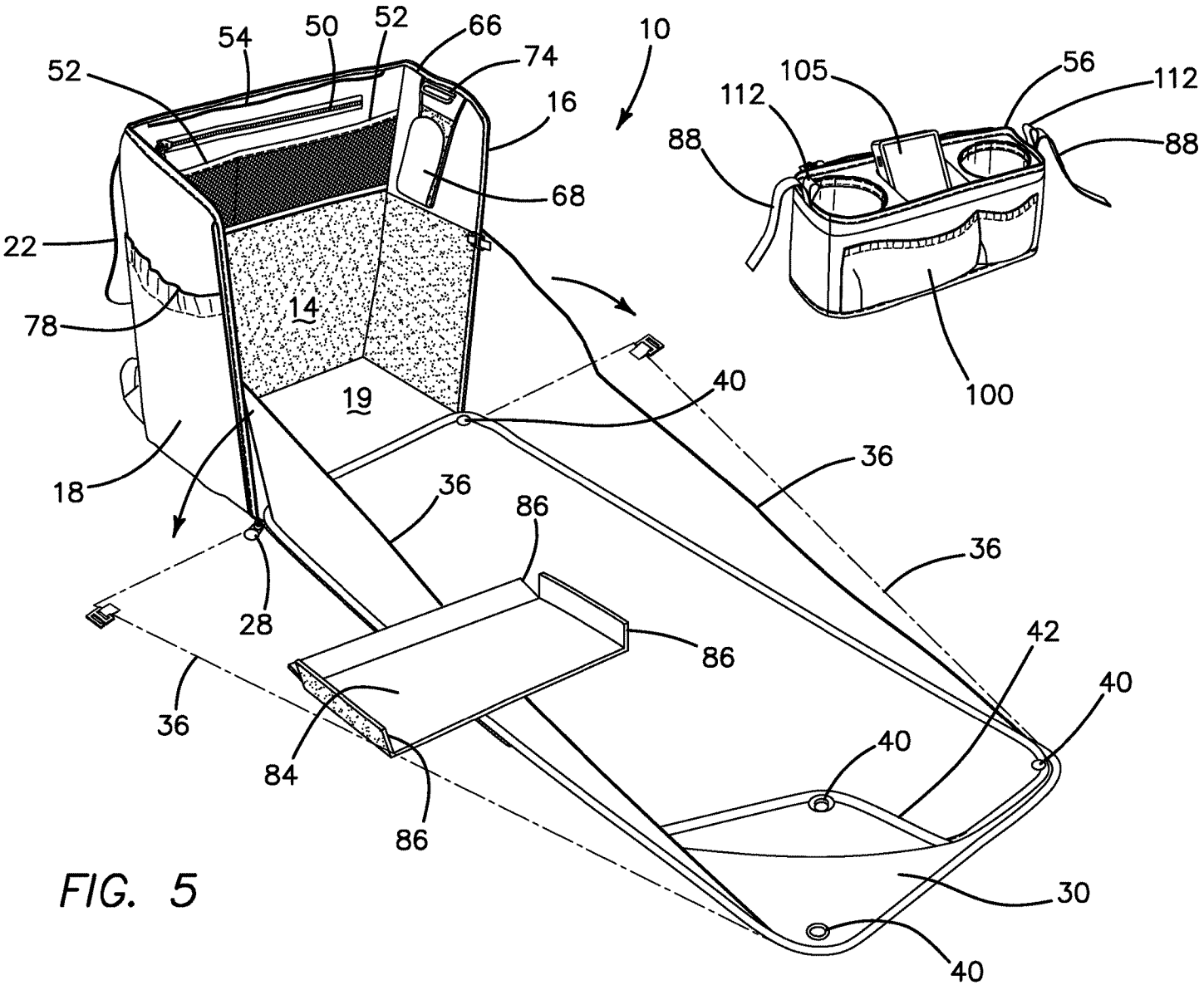
FIG. 5 is a top perspective view of a cell phone inside an inner stroller caddy removed from an outer stroller caddy with the front panel unzipped and unfolded and shelf removed according to the present invention.

The front panel 12 has a zipped and closed configuration in which both the first zipper 26 and the second zipper 28 are zipped to the first and second side panels 16, 18, as shown in FIG. 3, in which the front panel 12 is upstanding with respect to the bottom panel 19. The front panel 12 has an unzipped and closed position in which the first zipper 26 and second zipper 28 are unzipped and the front panel 12 remains upstanding with respect to the bottom panel. The front panel 12 has an unzipped and folded open configuration in which the first zipper 26 and the second zipper 28 are unzipped down to the bottom as shown in FIG. 4 and the front panel 12 is folded down at a connection seam with the bottom panel 19 such that, when placed on a flat surface, at least part of the inner surface 30 of the front panel 12 is flush or coplanar with the inner surface of the bottom panel 19. Also, when in the unzipped configuration, the front panel 12 is configured to unfold again into an unzipped and unfolded open configuration as shown in FIG. 5 in which the inner surface 30 of the front panel 12 is flush/coplanar with the inner surface of the bottom panel 19 along the entire length of the front panel 12. In one variation, the length of the front panel 12 when in the zipped configuration is approximately half of the length of the front panel 12 when in unzipped and unfolded open configuration. In other words, the front panel 12 is folded approximately in half from the unzipped and unfolded open configuration to achieve the unzipped and folded open or closed configuration wherein the front panel 12 is folded to have a length approximately equal to the height of the backpack 10. The front panel 12 includes a single fold 34 (see FIG. 4) from edge to edge to reduce the length of the front panel 12 to approximately equal the length of the first side panel 16, second side panel 18 and back panel 14 which is the approximate height of the backpack 10. The length of the front panel 12 in the unfolded configuration is nearly twice the length of the height of the backpack 10. In one variation, the height of the backpack is approximately 12 inches and the entire length of the front panel 12 in an unfolded configuration is approximately 22 inches. In another variation, the length of the front panel 12 is approximately three quarters longer than the height. The inner surface 30 of the front panel 12 is rectangular in shape. The first and second zippers 26, 28 extend along part of the edges of the front panel 12 approximately equal to the height of the side panels 16, 18. The edges of the front panel 12 distal beyond the fold 34 are not provided with zippers 26, 28. The front panel 12 unfolds with respect to the front edge of the bottom panel 19 from a zipped configuration in which the front panel 12 is vertical to a horizontal position and further unfolds a second time at fold 34 to a completely flat configuration to provide a long, cushioned and sanitary surface suitable for changing an infant's diapers. The inner surface 30 of the front panel 12 is smooth, waterproof and easy to clean.

The front panel 12 includes two oppositely disposed wings 36 on either side of the front panel 12. The wings 36 are connected to the front panel 12 along the side edges of the front panel 12. The wings 36 are triangular and are removably connected to the first and second side panels 16, 18 at the proximal apex of the triangular wings 36 via a hook and loop type fastener 38. The loop is connected to the side panels 16, 18 and the hook is connected to the proximal apex of the wings 36. When the wings 36 are unhooked and unfolded, a larger, flat changing surface is provided as shown in FIG. 5. When wings are hooked, they create angled sidewalls that taper down toward the distal end of the front panel 12. The angled sidewalls created by the wings 36 advantageously prevent and protect an infant from rolling off the changing area defined by the flat inner surface of the front panel 12. The inner surface 30 of the front panel 12 is provided with snaps 40 seen in FIG. 5. The snaps 40 are configured to removably attach a removable and washable inside lining 42. While snaps 40 are shown, any suitable fastener may be employed. Four snaps 40 are provided in the four corners of the inside surface 30 of the front panel 12 for connecting with four complementary snaps 40 connected to the removable inside lining 42. The inside lining 42 is made of plush and soft material such as cotton terry cloth to provide a clean, soft and washable surface that can be changed when dirty by unfastening the snaps 40 removing a soiled lining 42 and replacing it with a clean one. A waterproof inside lining 42 instead of a terry cloth fabric may also be employed.

Figure 6:
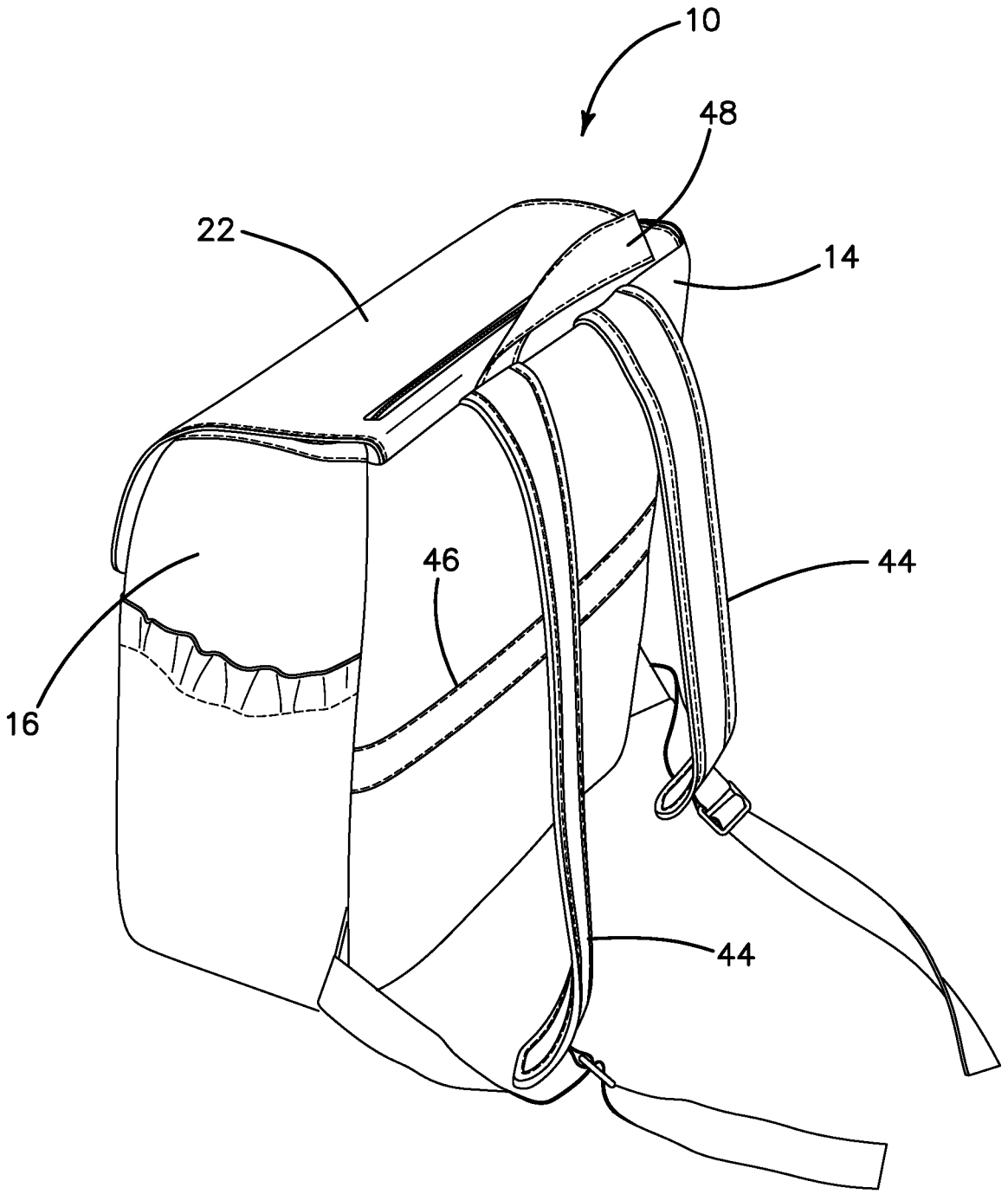
FIG. 6 is a top perspective back view of a stroller caddy according to the present invention.
Figure 7:
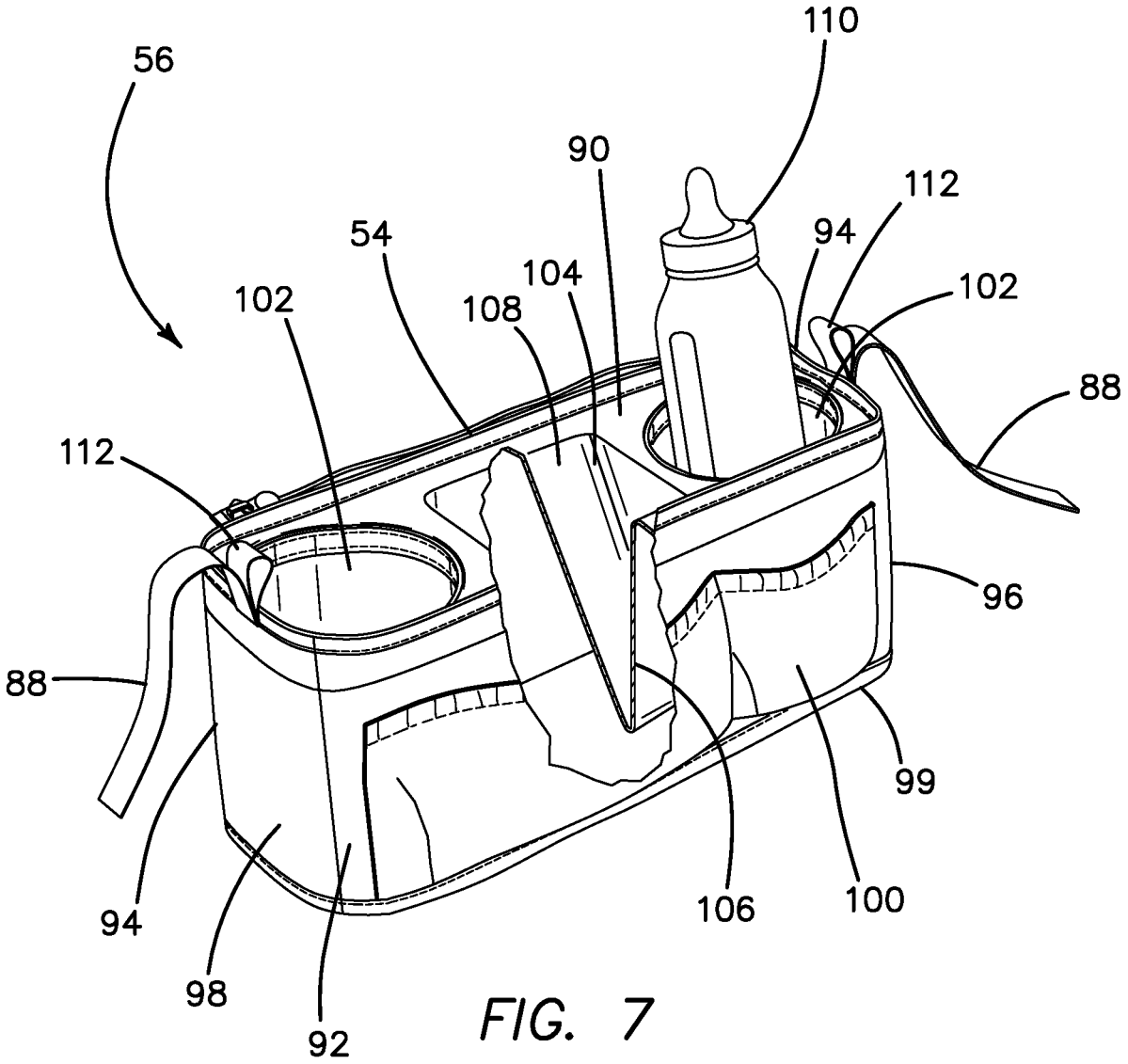
FIG. 7 is a partial sectional view of an inner stroller caddy according to the present invention.

The back panel 14 will now be described. The back panel 14 is rectangular in shape and includes an inner surface and an outer surface. The outer surface is provided with two backpack straps 44 as shown in FIG. 6. The straps 44 are for passing arms and carrying the backpack 10 on an individual's back. The outer surface of the back panel 14 includes a back pocket 46 provided with a zippered closure. A top loop 48 is connected to the top edge of the back panel 14. The top loop 48 assists in carrying or hanging the backpack 10. With reference to FIG. 5, the inner surface of the back panel 14 is provided with a deep zippered pocket 50 having a waterproof material suitable for storing wet items. The inner surface of the back panel 14 is also provided with at least one additional pocket 52 made of see-through, net, mesh material. The inner surface of the back panel 14 is provided with a zipper 54 at the top. The zipper 54 is configured to connect to a complementary zipper on a removable inner caddy 56 nested inside the larger backpack caddy. The inner caddy 56 will be described in greater detail below. At least the lower portion of the inner surface of the back panel 14 is provided with one of the hook material or loop material characteristic of a hook-and-loop type fastener such as VELCRO®. Preferably, the inner surface is provided with the loop material of the hook-and-loop type fastener because of its softer surface relative to the hook material.

The first side panel 16 will now be described. The first side panel 16 is rectangular in shape and includes an inner surface and an outer surface. The outer surface may be provided with a side pocket 58. The side pocket 58 may be sized and configured to receive a box or dispenser of wet napkins or wipes. The side pocket 58 may also be insulated to regulate the temperature of items inside the pocket 58 keeping them cool or warm as desired. The outer surface of the first side panel 16 at the front edge includes a zipper 26 for mating with the front panel 12 as discussed above. At least part of the inner surface of the first side panel 16 is covered with at least one of a hook material and loop material of a hook-and-loop type fastener such as VELCRO®. Preferably, at least the lower portion of the inner surface of the first side panel 16 is covered with loop material because it is softer to the touch. As shown in FIG. 5, the entire lower portion of the first side panel 16 is covered with loop material. The inner surface of the first side panel 16 further includes a loop part of the hook-and-loop type fastener 38 for attaching the proximal apex of a triangular wing 36. The loop is located at the front edge of the first side panel 16 and at the top of the loop-type material. The inner surface of the first side panel 16 further includes a first caddy strap 68 sized and configured to attach the backpack 10 to an infant stroller 70 as shown in FIG. 1. The caddy strap 68 is connected to the first side panel 16 at the top edge of the first panel 16. The inner surface of the first side panel 16 further includes an inner pocket 66 near the top edge of the side panel 16 sized and configured to conceal and stow the caddy strap 68 when it is not in use. The caddy strap 68 has an outer surface and an inner surface. The outer surface of the caddy strap 68 is provided with hook-and-loop type fastener material. In particular, the outer surface of the caddy strap 68 is provided with loop material at the proximal end and hook material at the distal end such that when folded outwardly into a loop such as around the handle of an infant stroller 70, the caddy strap 68 will fold back onto itself and the hook material at the distal end of the caddy strap 68 will mate with the loop material at the proximal end and securely attach thereto. The proximal end of the caddy strap 68 is provided with an elongate opening 72 passing through the caddy strap 68 that is sized and configured to allow passage of a hard plastic elongated hook 74 attached to the top edge of the first side panel 16 proximal to the point of attachment of the caddy strap 68. The hard-plastic hook 74 is sized and configured to receive loops 112 associated with the removable inner caddy 56 as will be described in greater detail below. The elongate opening 72 permits the elongated hook 74 to pass through and attach to the removable inner caddy 56 when the caddy strap 68 is up and wrapped around the handle bar of a stroller 70 or when the caddy strap 68 is down inside the pack and optionally concealed inside the stow pocket 66.

The second side panel 18 will now be described. The second side panel 18 is identical to the first side panel 16. The second side panel 18 is rectangular in shape and includes an inner surface and an outer surface. The outer surface is provided with a pocket 78 having an elastic closure. The outer surface at the front edge of the second side panel 18 includes the second zipper 28 for mating with the front panel 12. At least a portion of the inner surface of the second side panel 18 includes at least one of a hook material and loop material of a hook-and-loop type fastener such as VELCRO®. Preferably, at least the lower portion of the inner surface of the second side panel 18 is covered with loop material because it is softer to the touch. The inner surface of the second side panel 18 further includes a loop part of the hook-and-loop type fastener 38 similar to the first side panel 16. The loop is located at the front edge of the second side panel 18 and at the top of the loop type material covering the lower the inner surface of the second side panel 18. The loop part is configured to attach to a hook that is attached to a wing 36. The inner surface of the second side panel 18 further includes a second caddy strap 68 sized and configured to fold up and to attach the backpack 10 to a handle of an infant stroller 70 as shown in FIG. 1. The caddy strap 68 is connected to the second side panel 18 at the top edge of the panel. The caddy strap 68 can be stowed in the adjacent pocket (not shown) just like the opposite side panel 16. The caddy strap 68 has an outer surface and an inner surface. The outer surface of the caddy strap 68 is provided with hook-and-loop type fastener material. In particular, the outer surface of the caddy strap 68 is provided with loop material at the proximal end and hook material at the distal end such that when folded outwardly into a loop such as around the handle of an infant stroller 70, the caddy strap 68 will fold back onto itself and the hook material at the distal end of the caddy strap 68 will mate with the loop material at the proximal end and securely attach thereto. The proximal end of the caddy strap 68 is provided with an elongate opening 72 sized and configured to allow passage of a hard plastic hook 74 attached to the top edge of the second side panel 18 proximal to the point of attachment of the second caddy strap 68. The hook 74 is sized and configured to receive loops 112 associated with the removable inner caddy 56 as will be described in greater detail below. The elongate opening 72 in the caddy strap 68 permits the elongated hook 74 to pass through the caddy strap 68 and attached to the removable inner caddy 56 when the caddy strap 68 is positioned up and wrapped around the handle bar of a stroller 70 or when the caddy strap 68 is down inside the pack and optionally stowed in a pocket.

Figure 2:
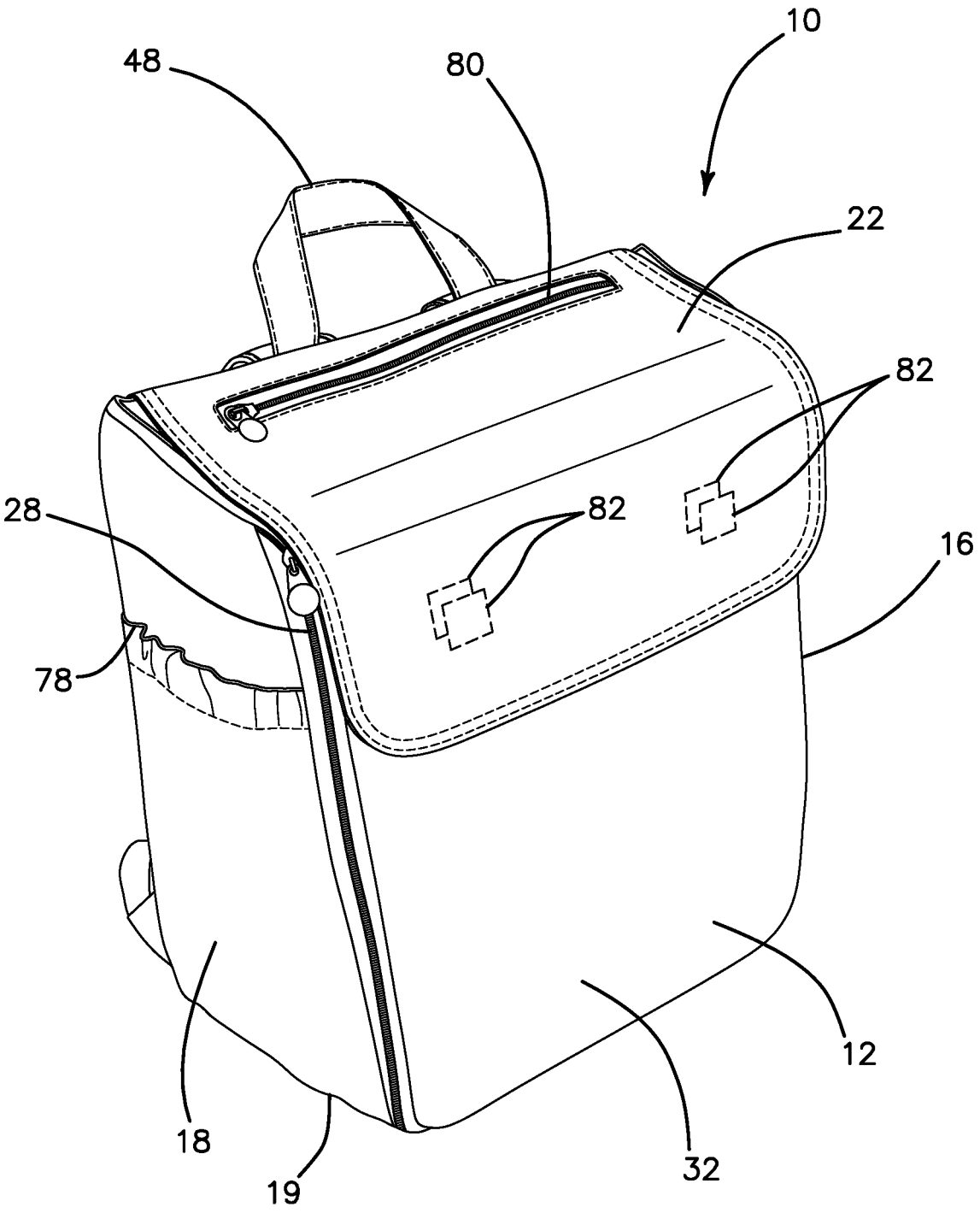
FIG. 2 is a top perspective front view of a stroller caddy in a zipped and closed configuration according to the present invention.

The top flap 22 is connected to the top edge of the back panel 14. The outer surface of the top flap 22 is provided with a zippered pocket 80. The top flap 22 is sized and configured to fold over, cover and close the top opening 24. The top opening 24 is defined by the top edges of the back panel 14, first side panel 16, second side panel 18 and the front panel 12 when the front panel 12 is folded up and closed. The top flap 22 is provided with magnetic fasteners 82 visible in FIGS. 2-3 and configured to keep the top flap 22 secured in a closed position yet easily openable with respect to the front panel 12 which has the mating magnetic fastener 82 embedded therein. A pair of magnetic fasteners 82 are provided inside the top flap 22 and a corresponding pair of magnetic fasteners 82 are provided in the front panel 12 such that they mate together to secure the top flap 22 to the front panel 12 in a closed configuration as shown in FIGS. 2 and 6. The top flap 22 is shown open in FIGS. 3-5.

The main interior compartment 20 is provided with one or more removable shelf 84 to help stow articles and divide the main interior compartment 20 into separate areas of storage. Two removable shelves 84 are shown in FIG. 4. The removable shelf 84 is rectangular in shape having a size approximately equal to the footprint of the bottom panel 19. Each removable shelf 84 is made of relatively more rigid material such as by having a rigid board located between cushioning. Three edges of the shelf 84 are provided with side flaps 86 having hook-and-loop type fastener material configured for mating engagement with the hook-and-loop type fastener material on the inner surfaces of the first side panel 16, second side panel 18 and back panel 14 to secure the shelf 84 in a removable fashion to the interior of the backpack 10. The position of the shelf 84 is adjustable along the inside of the backpack 10 along the inner surfaces covered with corresponding VELCRO®.

The removable inner caddy 56 will now be described. The inner caddy 56 is rectangular, box-like in shape and sized and configured to fit inside the main compartment 20 and held at the top of the main compartment 20 via inner caddy straps 88 and plastic hooks 74, loops 112 and zipper 54. The inner caddy 56 is removable by disconnecting the inner loops 112 from the hooks 74 and by unzippering the zipper 54. The removed inner caddy 56 can be used independently of the remaining backpack 10 as a mini-pack or caddy that is connectable via the inner caddy straps 88 to the handlebars of an infant stroller 70. The inner caddy 56 includes a front panel 92 and a back panel 94 interconnected by a first side panel 96, a second side panel 98 and a bottom panel 99 to define an interior. A top panel 90 is also included and connected to the front panel 92, back panel 94 and the side panels 98, 99. All of the panels are made of fabric material that is suitable and sturdy with rigidity such that the inner caddy 56 maintains a shape of a rectangular box. The panels include an outer fabric covering and an inner fabric covering with cushion material sandwiched therebetween. A rigid panel may be including between cushioning. A rectangular rigid reinforcing wire (not shown) is included between the inner and outer fabric coverings and located along the perimeter of the top of the inner caddy 56 to maintain a sturdy rectangular shape at the top end of the inner caddy 56. The front panel 92 includes at least one outer front pocket 100 with an elastic closure. The back panel 94 includes a zipper 54 at the top edge of the inner caddy 56 for connecting the inner caddy 56 to the zipper 54 on the back panel 14. The inner caddy 56 connects to the outer caddy 10 such that the top panel 90 is inside near the top end of the outer bag 10 in effect closing the top opening 24. When the top flap 22 is uncovered from the top opening 24, the top panel 90 of the inner caddy 56 is revealed and no access to the remainder of the interior compartment is available without unzipping the front panel 12 of the backpack 10. Each of the first side panel 96 and the second side panel 98 include a caddy strap 88 attached near the top edge. Each caddy strap 88 includes an inner surface and an outer surface. The outer surface of each caddy strap 88 includes a patch of hook material at the proximal end and a patch of hook material at the distal end of the strap 88. A patch of loop material is provided between the two patches of hook material. Each inner caddy strap 88 is configured to fold outwardly over itself to form a loop such as around the handle bar of an infant stroller 70 such that the distal patch of hook material mates with the middle loop material in a hook-and-loop type closure in order to secure the inner caddy 56 to the infant stroller 70 when used independently of the remaining backpack 10. To attach the inner caddy 56 to the remaining outer backpack or outer caddy, each caddy loop 112 is sized and configured to slide over and hook onto the hooks 74 on the first and second side panels 16, 18.

The top panel 90 of the inner caddy 56 includes at least one cylindrical opening 102 sized and configured to serve as a cup holder. Two cup holders are shown in the inner caddy 56. Between the two cup holders is a wedge-shaped, V-like, angled opening 104 sized and configured to receive a mobile phone 105. The opening 104 has two oppositely disposed substantially parallel vertical sidewalls interconnected by a front wall 106 and a back wall 108. In one variation, the front wall 106 is angled with respect to the top panel 90 and the back wall 108 is angled with respect to the top panel 90. In another variation, the front wall 106 is vertical/perpendicular relative to the top panel 90 and the back wall 108 is angled, slanted with respect to the top panel 90. The front wall 106, back wall 108 and sidewalls are made of fabric or other suitable material to form a wedge-shaped opening 104 sized and configured to conveniently hold a cell phone 105 in an angled configuration such that the screen/display of the cell phone 105 is angled, slanted toward and visible to the user when the inner caddy 56 is attached to an infant stroller 70 with or without the remaining backpack. A typical mobile device such as a cell phone is rectangular and planar in shape having a display on one side. When placed inside the wedge-shaped opening 104, the back side of the device is placed against the angled back wall 108. The wedge-shaped opening advantageously creates space between the front side display of the device and the front wall 106 such that a display on the front side of the device is visible and not obscured by the opening 104. The V-shape is wider at the top panel and narrows towards the bottom panel. When placed inside the wedge-shaped opening 104, at least part (such as at least half) of the length of a mobile device is inside the wedge-shaped pocket with the remaining length of the mobile device residing above the top panel. As such, the depth of V-shaped opening is at least half of the length of the mobile device. In one variation, the depth is at least approximately three inches. In another variation, the V-shaped opening 104 has a depth of approximately 5.25 inches from the top panel 90 and a width from sidewall to sidewall is approximately 3.5 inches. In one variation, the cylindrical openings 102 and wedge-shaped opening 104 are made of flexible, waterproof, fabric material and, in another variation, the openings 102, 104 are made of relatively more rigid hard plastic.

In use, the backpack 10 is filled with a variety of baby accessories 107 and enclosed inside the main interior compartment 20 as shown in FIG. 4. Caddy straps 68 are exposed along the sides of a closed top flap 22. Alternatively, the caddy straps 68 are exposed while the top flap 22 is uncovered. To expose the caddy straps 68, the caddy straps 68 are folded upwardly into a vertical orientation. In doing so, the hooks 74 easily pass through the elongate opening 72 on the caddy straps 68 such that they can engage with the loops 112 on the inner caddy 56. Each exposed caddy strap 68 is folded toward itself into a loop around the handlebars of an infant stroller 70. The VELCRO® on the straps 68 are connected to secure the backpack 10 to the stroller. If the top flap 22 is open, the inner caddy 56 is exposed. Preferably, the backpack 10 is attached such that the top flap 22 folds away from the stroller 70. With the top flap 22 open, the beverage openings 102 hold and provide easy access for adult and/or child beverages such as a baby bottle 110. A cell phone 105 may be placed inside the wedge-shaped opening 104 that is sized and configured to hold a cell phone 105 at an angle such that an adult pushing an infant stroller 70 can glance downwardly and advantageously observe the screen at an optimal angle that prevents screen blackout in order to see who is calling or texting, check a map instead of using one or more hands to find a cell phone, access the cell phone from a pocket or elsewhere and holding the cell phone with one hand to see who is calling or texting which would require removing one or both hands from the handle bars of the stroller 70 taking attention away from the child.

When a sanitary surface is required, the user may remove the backpack 10 from the infant stroller 70 and unzip the zippers 26, 28 and unzip the front panel 12 from a vertical orientation to horizontal orientation and unfold the front panel with respect to the bottom panel 19 and then again unfold the front panel 12 at the front fold 34. When connected to the side panels 16, 18, the wings 36 providing stability to the backpack 10 when placed on the ground or other flat surface. The front panel 12 may be further unfolded at the fold 34 such that a larger sanitary surface or resting area is provided. Unfolding the front panel 12, not only, provides a larger surface, but also, exposes the removable inside lining 42. Advantageously, the removable inside lining easily snaps to the inner surface of the front panel 12 for removal and washing. If an even larger sanitary surface is required the wings 36 are disconnected from the side panels 16, 18 by undoing the hook/loop fastener 38 and folding the wings 36 laterally outwardly. When folded outwardly, the wings 36 are substantially coplanar with the front panel 12 and bottom panel 19 as shown by the dotted lines in FIG. 5. Alternatively, the infant may be changed by keeping the wings 36 attached and in vertical orientation with the support surface or inner surface 30 of the front panel 12. The vertically orientated wings 36 advantageously prevent the infant from rolling off the front panel 12 and, also, advantageously shield the child's vision giving the child more privacy and a secure feeling creating a more comforting diaper-changing experience. With the front panel 12 unzipped and folded outwardly at the intersection of the front panel 12 with the bottom panel 19, the entire interior compartment 20 is visible to the user and the user may, in turn, easily access everything inside the interior compartment 20 front of the outer bag 10. This cabinet-like arrangement allows the user to advantageously and quickly access wipes, diapers, lotion quickly and easily from the shelves especially while a baby is laying on the unfolded front panel 12. The inner shelves 84 are connected in a cabinet-like or bookshelf-like fashion such that their back and side edges are abutted against the back panel and side panels, respectively, leaving the front edge of a shelf exposed when the front panel is zipped down. The inner shelves 84 can be removed to provide a single large storage space. Alternatively, the position of one or more inner shelves 84 may be advantageously adjusted via the VELCRO® fastener via the side flaps 86 used to connect the shelf 84 to the inside of the backpack 10 for ultimate storage versatility.

The inner caddy 56 may be advantageously removed from the interior compartment 20 by disconnecting the loops 112 from the hooks 74 to provide even more storage space inside the backpack 10 or, alternatively, to be used independently of the backpack 10 when fewer items are needed for an outing. The inner caddy 56 is nested inside the outer caddy/backpack 10 and can be removed by undoing the zipper 54 at the back panel 94 and sliding the loops 112 off the hooks 74. Also, VELCRO® may be additionally employed to connect the inner caddy 56 to the inner surfaces of side panels 16, 18 and back panel 14 and this VELCRO® may be disconnected to remove the inner caddy 56. The inner caddy 56 may then be used independently of the rest of the backpack 10 for carrying beverages and cell phone and other small items that fit inside the front pocket 100. The inner caddy 56 may also be attached to the handlebars of an infant stroller 70 by folding the caddy straps 88 toward itself to mate the VELCRO® patches forming a loop around the handlebars and securing the inner caddy 56 to the stroller 70. Hence, the present invention advantageously combines a diaper bag that serves as a backpack with a removable stroller caddy that is also attachable to a stroller for carrying beverages and cell phone. The removable stroller caddy may be used with the backpack or detached from the backpack and used independently by itself. Some infant strollers already include an attached or built-in caddy and there is no room for an additional caddy or diaper bag to attach to the stroller. Also, infant strollers that already provide an attached stroller caddy do not provide the functionality and storage space of a diaper bag. Therefore, the user must carry the diaper bag over the shoulder or in one hand or forgo carrying all of the essentials in one place. In the present invention, the combined inner caddy and diaper bag permit the user advantageously to be hands-free while providing both the storage space and convenience of a beverage and cell phone caddy at the same time which is a convenience to the user that also translates into more safety and security for the child.

It is understood that various modifications may be made to the embodiments of the combination backpack and double (inner and outer) stroller caddy disclosed herein. Therefore, the above description should not be construed as limiting, but merely as exemplifications of preferred embodiments. Those skilled in the art will envision other modifications within the scope and spirit of the present disclosure.

I claim:

1. An infant care bag comprising:

an outer bag having a top end and a bottom end and including a front panel and a back panel interconnected by a bottom panel, a first side panel and a second side panel defining an interior having a top opening; the front panel being oppositely disposed from the back panel and the first side panel being oppositely disposed from the second side panel; a top flap connected to the back panel and sized and configured to fold over the top opening; a first outer bag strap having a proximal end and a distal end; the proximal end of the first outer bag strap being connected to the top end of the outer caddy; a second outer bag strap having a proximal end and a distal end; the proximal end of the second outer bag strap being connected to the top end of the outer bag; wherein the first outer bag strap is directly connected to the first side panel of the outer bag and a second outer bag strap is directly connected to the second side panel of the outer bag; and a removable inner caddy including a top end and a bottom end and including a front panel and a back panel interconnected by a top panel, a bottom panel, a first side panel and a second side panel; the front panel of the inner caddy being oppositely disposed from the back panel of the inner caddy and the first side panel of the inner caddy being oppositely disposed from the second side panel of the inner caddy; wherein the inner caddy is sized and configured to removably nest inside the outer bag such that the top panel of the inner caddy is located at the top end of the outer bag closing the top opening of the outer bag; the back panel, front panel, first side panel, and second side panel of the inner caddy face the back panel, front panel, first side panel and second side panel of the outer bag, respectively, when the inner caddy nested inside the outer bag; a first inner caddy strap having a proximal end and a distal end; the proximal end of the first inner caddy strap being connected to the top end of the inner caddy; a second inner caddy strap having a proximal end and a distal end; the proximal end of the second inner caddy strap being connected to the top end of the inner caddy; wherein the first inner caddy strap is directly connected to the first side panel of the inner caddy and the second inner caddy strap is directly connected to the second side panel of the inner caddy.

2. The infant care bag of claim 1 wherein the first outer bag strap and the second outer bag strap are sized and configured to removably attach to and hang from an infant stroller; and the first inner caddy strap and the second inner caddy strap are sized and configured to removably attach to and hang from an infant stroller.

3. The infant care bag of claim 1 wherein the top opening has a perimeter that is rectangular in shape.

4. The infant care bag of claim 1 wherein the top panel of the inner caddy has at least one cylindrical beverage container receptacle.

5. The infant care bag of claim 1 wherein the top panel includes a wedge-shaped opening that is sized and configured to hold a mobile phone at an angle.

6. The infant care bag of claim 1 wherein the first outer bag strap includes a hook-and-loop type fastener along a length of the first outer bag strap at the distal end; and wherein the second outer bag strap includes a hook-and-loop type fastener along a length of the second outer bag strap at the distal end.

7. The infant care bag of claim 1 wherein the first inner caddy strap includes a hook-and-loop type fastener along a length of the first inner caddy strap at the distal end; and wherein the second inner caddy strap includes a hook-and-loop type fastener along a length of the second inner caddy strap at the distal end.

8. The infant care bag of claim 1 wherein the outer bag includes a first hook on an inner surface of the first side panel near the top end and a second hook on an inner surface of the second side panel near the top; the inner caddy includes a first loop connected to the top end of the first side panel of the inner caddy and a second loop connected to the top end of the second side panel of the inner caddy; wherein the first hook is removably connectable to the first loop and the second hook is removably connectable to the second loop to connect the inner caddy to the outer bag.

9. The infant care bag of claim 1 wherein the inner caddy includes a first side of a zipper fastener on an outer surface of the back panel near the top end that is removably connectable to a second side of a zipper fastener on an inner surface of the back panel near the top end of the outer bag.

10. The infant care bag of claim 1 wherein an outer surface of the back panel of the outer bag includes a pair of backpack straps.

11. The infant care bag of claim 1 wherein the back panel, first side panel and the second side have an equal length that is shorter than an unfolded length of the front panel.

12. The infant care bag of claim 1:

having a height from a top end to a bottom end of the outer bag; the front panel having a first zipper along a first side edge of the front panel from the top end to the bottom end that is removably connectable to a zipper located along a front edge of the first side panel from the top end to the bottom end; the front panel having a second zipper along a second side edge of the front panel from the top end to the bottom end that is removably connectable to a zipper located along a front edge of the second side panel from the top end to the bottom end; wherein when in an unzipped configuration the front panel is configured to fold outwardly at an intersection with the bottom panel such that the inner surface of the front panel is coplanar with the inner surface of the bottom panel; the interior being accessible from the front when in the unzipped configuration.

13. The infant care bag of claim 12 wherein the front panel has a length longer than the height of the bag; the front panel having a fold near the top end to reduce the length of the front panel to a length equal to the height of the bag.

14. The infant care bag of claim 13 wherein the length of the front panel is at least two thirds longer than the height of the bag.

15. The infant care bag of claim 13 wherein when in an unzipped configuration the front panel folds outwardly at the fold such that the entire inner surface of the front panel is coplanar with the inner surface of the bottom panel.

16. The infant care bag of claim 13 wherein a first wing of triangular material is connected along the first side edge of the front panel and a second wing of triangular material is connected along the second side edge of the front panel.

17. The infant care bag of claim 16 wherein the first wing is connected to the front edge of the first side panel and the second wing is connected to the front edge of the second side panel such that in an unzipped configuration with the front panel unfolded, the first wind and second wing are perpendicular to the front panel.

18. The infant care bag of claim 1 further including at least one removable shelf having a top surface and a bottom surface interconnected by a first side edge, a second side edge, a front edge and a back edge.

19. The infant care bag of claim 18 wherein the inner surfaces of the back panel, first side panel and second side panel are covered with one of a hook and a loop material; the shelf having the other one of a hook and a loop material for connecting the shelf to at least two of the back panel, first side panel and second side panel.

* * * * *